US007987936B2

(12) United States Patent
Yamakura et al.

(10) Patent No.: US 7,987,936 B2
(45) Date of Patent: Aug. 2, 2011

(54) AIR GUIDE PLATE

(75) Inventors: Yutaka Yamakura, Saitama (JP); Takero Shibukawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 391 days.

(21) Appl. No.: 11/822,522

(22) Filed: Jul. 6, 2007

(65) Prior Publication Data

US 2008/0006329 A1 Jan. 10, 2008

(30) Foreign Application Priority Data

Jul. 10, 2006 (JP) ..... 2006-189222

(51) Int. Cl.
*F28F 99/00* (2006.01)

(52) U.S. Cl. ..... 180/68.1; 180/68.2; 180/229; 137/354

(58) Field of Classification Search ..... 180/68.1, 180/68.2

See application file for complete search history.

(56) References Cited

U.S. PATENT DOCUMENTS 4,633,965 A * 1/1987 Tsurumi et al. ..... 180/229
4,637,486 A * 1/1987 Iwai ..... 180/225
4,799,569 A * 1/1989 Hattori et al. ..... 180/219
5,145,023 A * 9/1992 Tsurumi et al. ..... 180/68.1

FOREIGN PATENT DOCUMENTS

| | | |
|---|---|---|
| JP | S57-182584 | 11/1982 |
| JP | 9-62104 B2 | 8/1994 |
| JP | 10-203458 A | 8/1998 |
| JP | 10-236364 A | 9/1998 |

* cited by examiner

*Primary Examiner* — Tony H. Winner
*Assistant Examiner* — Jacob Knutson
(74) *Attorney, Agent, or Firm* — Birch, Stewart, Kolasch & Birch, LLP

(57) ABSTRACT

To prevent an engine from being thermally affected by the air that has passed a radiator. A engine and a radiator for cooling the engine are attached to the body frame. An air guide plate permits lead air striking the radiator to a desired position to be disposed between the radiator and the engine. The air guide plate is formed with an upper wall at its upper portion, with lateral walls at its respective left and right lateral portion, and with an opening portion at its lower portion for discharging the discharge air of the radiator.

17 Claims, 11 Drawing Sheets

AIR GUIDE PLATE

CROSS-REFERENCE TO RELATED APPLICATIONS

The present application claims priority under 35 USC 119 to Japanese Patent Application No. 2006-189222 filed on Jul. 10, 2006 the entire contents of which are hereby incorporated by reference.

BACKGROUND OF THE INVENTION

1. Field of the Invention

The present invention relates to an improvement of an air guide plate for a vehicle.

2. Description of Background Art

A heat shield plate for preventing a carburetor or air cleaner from receiving the air passing a radiator is known as a component having the function of an air guide plate for a conventional vehicle. See, e.g. Japanese Patent Laid-open No. Hei 6-62104.

FIG. 1 of Japanese Patent Laid-open No. Hei 6-62104 is described below wherein a heat shield plate 6 is disposed rearwardly of a radiator 5 and forward of the cylinder head 2*h* of an engine 2 so as to extend obliquely to a position above the cylinder head 2*h*. The air passing the radiator 5 is led by the head shield plate 6 rearwardly and obliquely downwardly toward the cylinder head 2*h*, thus shielding the carburetor 3 disposed rearwardly of the head shield plate 6 from heat.

Since the cylinder head 2*h* of the engine 2 receives the air that has passed the radiator 5 to warm up, it is possible that the cylinder head 2*h* may rise in temperature. If the air flows along the cylinder head 2*h* rearwardly and obliquely downwardly, then it has a thermal influence on also the lower portion of the engine 2.

SUMMARY AND OBJECTS OF THE INVENTION

It is an object of an embodiment of the present invention to prevent an engine from being thermally affected by the air that has passed a radiator According to an embodiment of the present invention, an air guide plate for a vehicle including an engine and a radiator for cooling the engine are both attached to a body frame. An air guide plate is adapted to lead air striking the radiator to a desired position, the air guide plate is disposed between the radiator and the engine and is formed with an upper wall at an upper portion thereof, with lateral walls at respective left and right lateral portions thereof, and with an opening portion at a lower portion thereof.

In operation, the discharge air that has passed the radiator is gathered in the central portion of the air guide plate by the upper walls and lateral walls of the air guide plate disposed rearwardly of the radiator and is discharged downwardly from the opening portion formed at the lower portion of the air guide plate. Thus, the engine does not receive the discharge air.

According to an embodiment of the present invention, the body frame includes a pair of left and right down tubes extending almost downwardly from a head pipe provided at a front end of the body frame. The radiator is disposed forward of the down tubes with respect to the vehicle body, and the left and right lateral walls are disposed between the left and right down tubes so as to overlap the down tubes as viewed from the lateral side.

In operation, a portion between the left and right down tubes is a space adapted to dispose the air guide plate therein and to cause the discharge air of the radiator disposed forward of the down tubes to flow therein.

According to an embodiment of the present invention, the air guide plate is provided with a notch adapted to receive an exhaust pipe passed therethrough, the exhaust pipe extends from the engine.

In operation, when the discharge air of the radiator is led downwardly by the air guide plate with the exhaust pipe extending from the engine passing through the notch of the air guide plate, the hot air emitted by the exhaust pipe is also led downwardly.

According to an embodiment of the present invention, the air guide plate is provided with extensions which are respectively disposed on the leftward and rightward externally lateral sides of the left and right down tubes and the left and right extensions are respectively supported by the support portions provided on external lateral surfaces of the left and right down tubes.

In operation, when the air guide plate is attached to the down tubes, the left and right extensions are attached, from the lateral side of the vehicle body, to the support portions provided on the external lateral sides of the left and right down tubes.

According to an embodiment of the present invention, the air guide plate is disposed between the radiator and the engine and is formed with an upper wall at an upper portion thereof, with lateral walls at respective left and right lateral portions thereof, and with an opening portion at a lower portion thereof. Therefore, the discharge air that has passed the radiator can be discharged downwardly along the air guide plate to prevent the engine from getting the discharge air of the radiator, which prevents the thermal influence on the engine.

According to an embodiment of the present invention, the body frame includes a pair of left and right down tubes extending almost downwardly from a head pipe provided at a front end of the body frame, the radiator is disposed forward of the down tubes with respect to the vehicle body, and the left and right lateral walls are disposed between the left and right down tubes so as to overlap the down tubes as viewed from the lateral side. Therefore, the space between the left and right down tubes can effectively be utilized as a space adapted to dispose the air guide plate therein and as a discharge air passage, thereby causing the discharge air to be led downwardly of the engine.

According to an embodiment of the present invention, since the air guide plate is provided with a notch adapted to receive an exhaust pipe passed therethrough, the exhaust pipe extending from the engine, the hot air of the exhaust pipe can be led downwardly of the engine by the discharge air of the radiator. This makes it difficult for the engine to receive the hot air of the exhaust pipe.

According to an embodiment of the present invention, the air guide plate is provided with extensions which are respectively disposed on the leftward and rightward externally lateral sides of the left and right down tubes and the left and right extensions are respectively supported by the support portions provided on external lateral surfaces of the left and right down tubes. Therefore, the guide plate is easily attached to the down tubes from the lateral side of the vehicle body, which can enhance assembly performance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
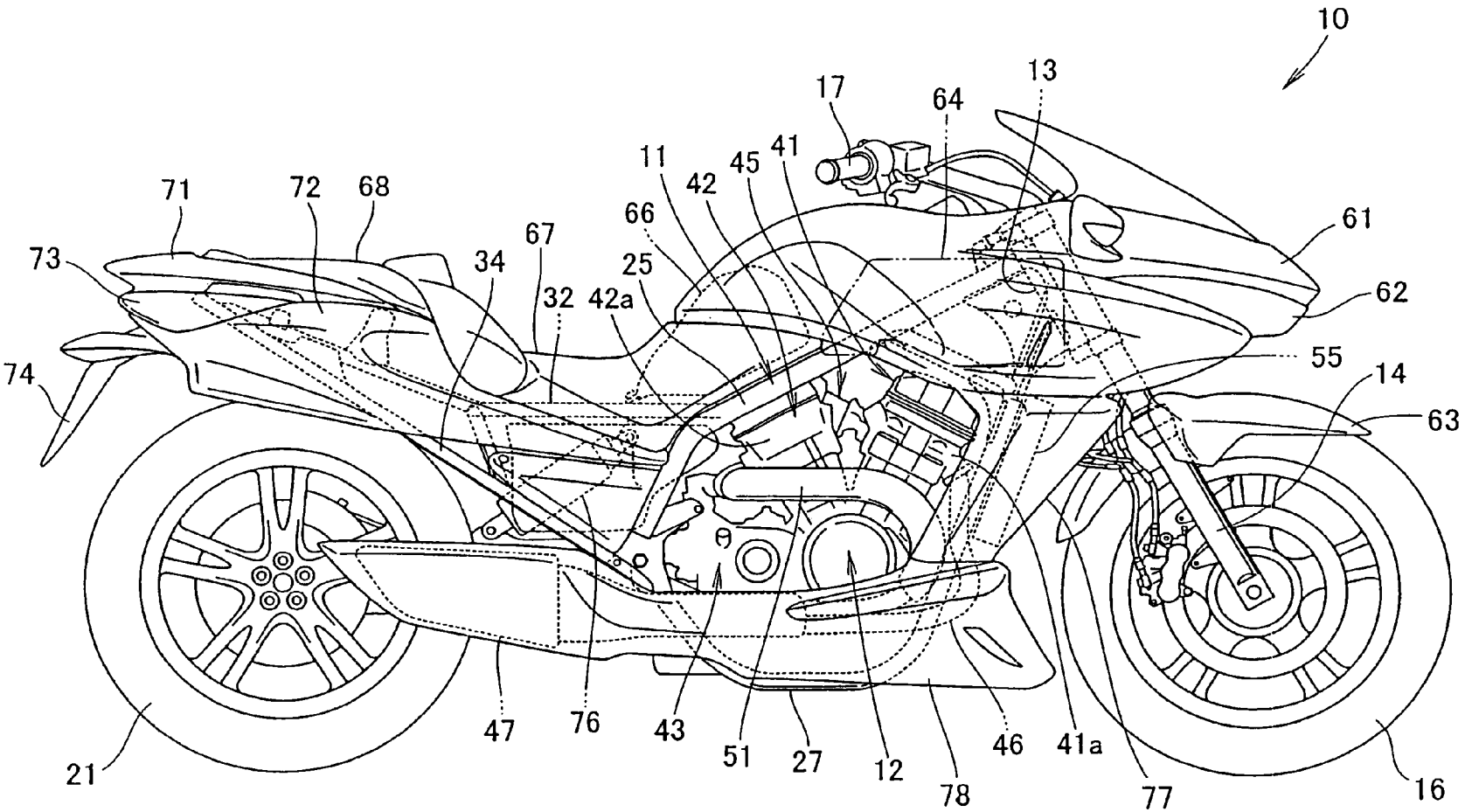
FIG. 1 is a lateral view of a vehicle equipped with an air guide plate according to the present invention.

The best mode for carrying out the invention will hereinafter be described with reference to the accompanying drawings. It is to be noted that the drawings shall be viewed based on the direction of reference numerals.

FIG. 1 is a lateral view of a vehicle equipped with an air guide plate according to the present invention. The vehicle 10 includes a body frame 11 serving a framework with a V-type water-cooled engine 12 disposed at the central portion of the body frame 11. A front fork 14 is steerably joined to a head pipe 13 provided at the front end of the body frame 11. In addition, the vehicle 10 includes a front wheel 16 attached to the lower end of the front fork 14 with handlebars 17 joined to the upper end of the front fork 14. A swing arm (not shown) is swingably attached to the rear lower portion of the body frame 11. A rear wheel 21 is attached to the rear end of the swing arm.

The body frame 11 includes the head pipe 13 with a pair of left and right main frames 24, 25 (only reference numeral 25 on the front side is shown) being provided and a pair of left and right down tubes 26, 27 (only reference numeral 27 on the front side is shown). A pair of left and right seat rails 31, 32 (only reference numeral 32 on the front side is shown) is provided with a pair of left and right sub-frames 33, 34 (only reference numeral 34 on the front side is shown). The main frames 24, 25 extend from the head pipe 13 rearwardly and oblique downwardly of the vehicle. The down tubes 26 and 27 extend almost downwardly from the head pipe 13, and then extending almost rearwardly and then are connected with the ends of the main frames 24 and 25, respectively. The seat rails 31 and 32 extend rearwardly from the main frames 24 and 25, respectively. The sub-frames 33 and 34 extend from the rear ends of the down tubes 26 and 27, respectively, rearwardly and obliquely upwardly and connect with the rear ends of the seat rails 31 and 32, respectively.

The engine 12 is provided with a front cylinder part 41 and a rear cylinder part 42 at the front upper portion thereof. A transmission 43 is integrally joined to the rear portion of the engine 12.

An air intake device 45 is disposed between the front cylinder part 41 and the rear cylinder part 42 so as to be connected therewith.

The front cylinder part 41 is provided with a cylinder head 41*a*. An exhaust pipe 46 is connected to the front portion of the cylinder head 41*a* and extends downwardly and rearwardly. A muffler 47 is connected to the rear end of the exhaust pipe 46.

The rear cylinder part 42 is provided with a cylinder head 42*a*. An exhaust pipe 51 is connected to the rear portion of the cylinder head 42*a* and extends forward, then makes a U-turn, and further extends rearwardly. The muffler 47 mentioned above is connected to the rear end of the exhaust pipe 51.

A radiator 55 cools cooling water flowing inside the engine 12. The radiator 55 is disposed forward of the front cylinder part 41 of the engine 12 and also forward of the left and right down tubes 26, 27 and is attached to the down tubes 26, 27.

A front upper cowl 61 is provided together with a headlamp 62, a front fender 63, an intake box 64 constituting part of the air intake device 45, a fuel tank 66, a rider's seat 67, a pillion 68, a grab rail 71, a rear cover 72, a tail lamp 73, a rear fender 74, a rear shock absorber 76 spanned between the side of the body frame 11 and the swing arm, a middle cowl 77 and a lower cowl 78.

Figure 2:
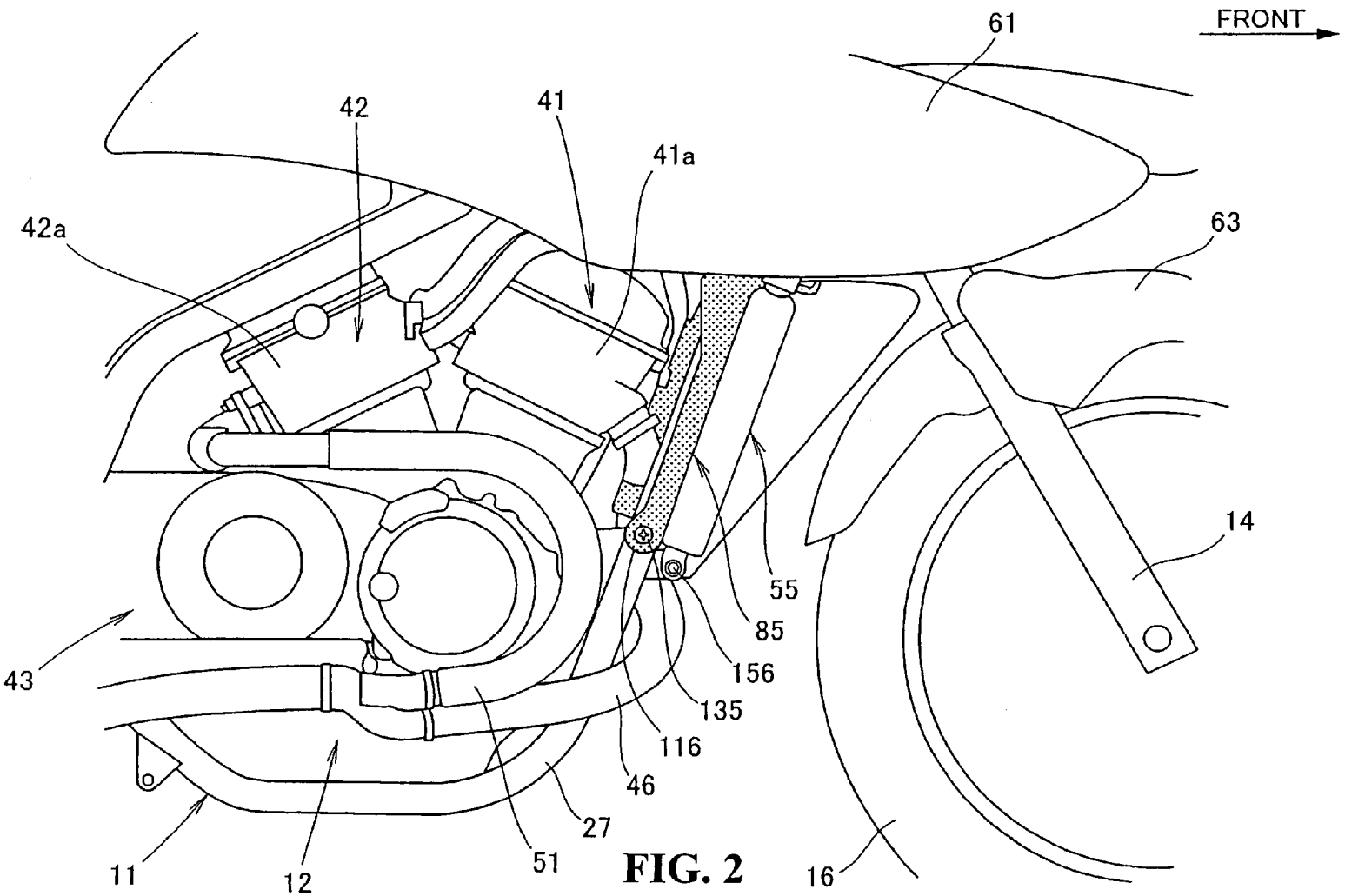
FIG. 2 is a lateral view of an essential part of the vehicle according to the present invention.

FIG. 2 is a lateral view of an essential portion of the vehicle according to the present invention (Arrow "FRONT" denotes the front of the vehicle). As illustrated in FIG. 2, an air guide plate 85 is disposed between the front cylinder part 41 of the engine 12 and the radiator 55. The air guide plate 85 directs the air that has passed the radiator to warm up, namely, the discharge air of the radiator 55, to the oblique downside to prevent the engine 12 from receiving the discharge air of the radiator 55. The air guide plate 85 is illustrated with dots in the FIG. 2 to facilitate the grasp of the position of the air guide plate 85 (which applies to the other figures).

In this way, it is possible to avoid the thermal influence of the discharge air of the radiator on the engine 12 by allowing the air guide plate 85 to prevent the engine 12 from receiving the discharge air of the radiator 55. In addition, since the discharge air of the radiator 55 flows from the air guide plate 85 toward the downside of the engine 12, the feet of a rider located on the lower lateral sides of the engine 12 does not receive the discharge air of the radiator 55, which will not impair the rider's comfort.

Figure 3:
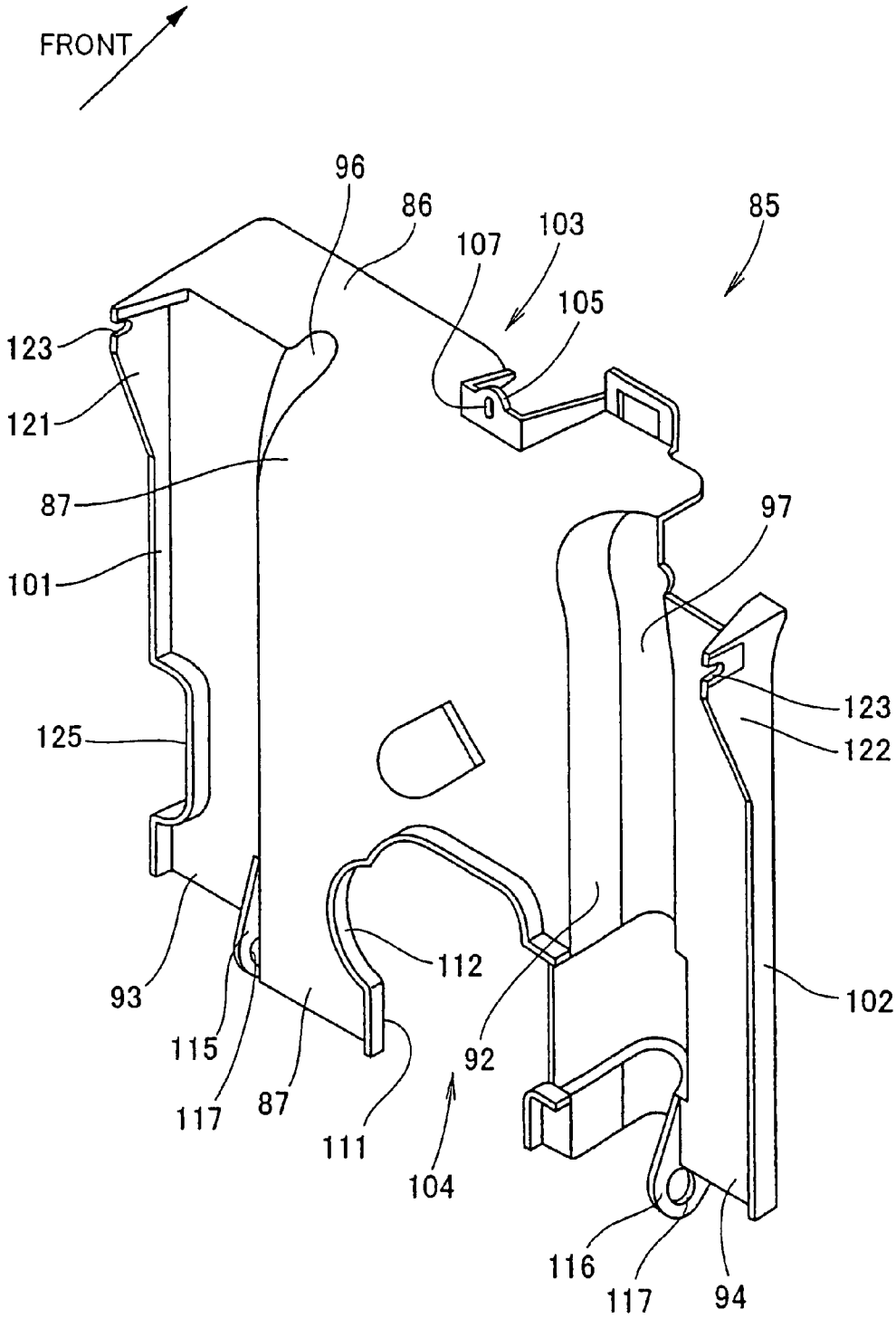
FIG. 3 is a perspective view of the air guide plate according to the present invention.

FIG. 3 is a perspective view of the air guide plate according to the present invention. The air guide plate 85 is a resin made component which is integrally formed of the following parts, an upper wall 86, an rear wall 87, lateral walls 91, 92 (only reference numeral 92 is shown), laterally extending walls 93, 94, a left-hand longitudinal groove 96, a right-hand longitudinal groove 97, and edge walls 101, 102. The upper wall 86 is provided at the upper portion of the air guide plate 85. The rear wall 87 bends from the rear end of the upper wall 86 and extends downwardly. The lateral walls 91 and 92 extend forward from the left and right edge portions, respectively, of the rear wall 87. The laterally extending walls 93, 94 extend laterally in parallel to the rear wall 87 and are located forward of the rear wall 87. The left longitudinal groove 96 is formed in a U-shape in cross-section and is provided between the lateral wall 91 and the laterally extending wall 93 so as to extend upwardly and downwardly. The right-hand longitudinal groove 97 is formed in a U-shape in cross-section and is provided between the lateral wall 92 and the laterally extending wall 94 and extends upwardly and downwardly. The edge walls 101 and 102 are respectively formed at the edge portions of the laterally extending walls 93 and 94.

The upper wall 86, rear wall 87 and lateral walls 91, 92 defines a recess portion 103 which is located on the front side of the sir guide plate 85.

The recess portion 103 forms an air guide passage adapted to lead the discharge air of the radiator 55 (see FIG. 2) to the downside. In addition, the recess portion 103 is formed at its lower end with an opening portion 104 adapted to discharge the discharge air of the radiator.

The upper wall 86 is formed with an upper attachment portion 105 to be attached to the side of the body frame 11 (see FIG. 1). In addition, an upper attachment hole 107 is formed in the upper attachment portion 105.

The rear wall 87 is bored with a notch 111 adapted to receive the exhaust pipe passing therethrough. In addition, a reinforcing rib 112 is formed at the edge portion of the notch 112.

The left-hand and right-hand longitudinal grooves 96 and 97 are adapted to receive the down tubes 26 and 27, respectively, passed therethrough.

The laterally extending walls 93 and 94 are respectively located rearwardly of side tanks 168 and 169 (see FIG. 10) of the radiator 55 detailed later and adapted to lead a portion of the discharge air of the radiator 55 downwardly. In addition, the laterally extending walls 93 and 94 are respectively formed with lower attachment portions 115 and 116 to be attached to the lateral portions of the down tubes 26 and 27. In addition, lower attachment holes 117, 117 are bored in the respective lower attachment portions 115 and 116.

The edge walls 101 and 102 are provided at their upper portions with lateral upper attachment portions 121 and 122 to be attached to the down tubes 26 and 27, respectively. In addition, side notched portions 123, 123 are formed in the lateral upper attachment portions 121, 122 so as to receive attachment screws passed therethrough. A lateral lower notch 125 is formed in one of the side walls 101 to prevent interference with other components.

Figure 4:
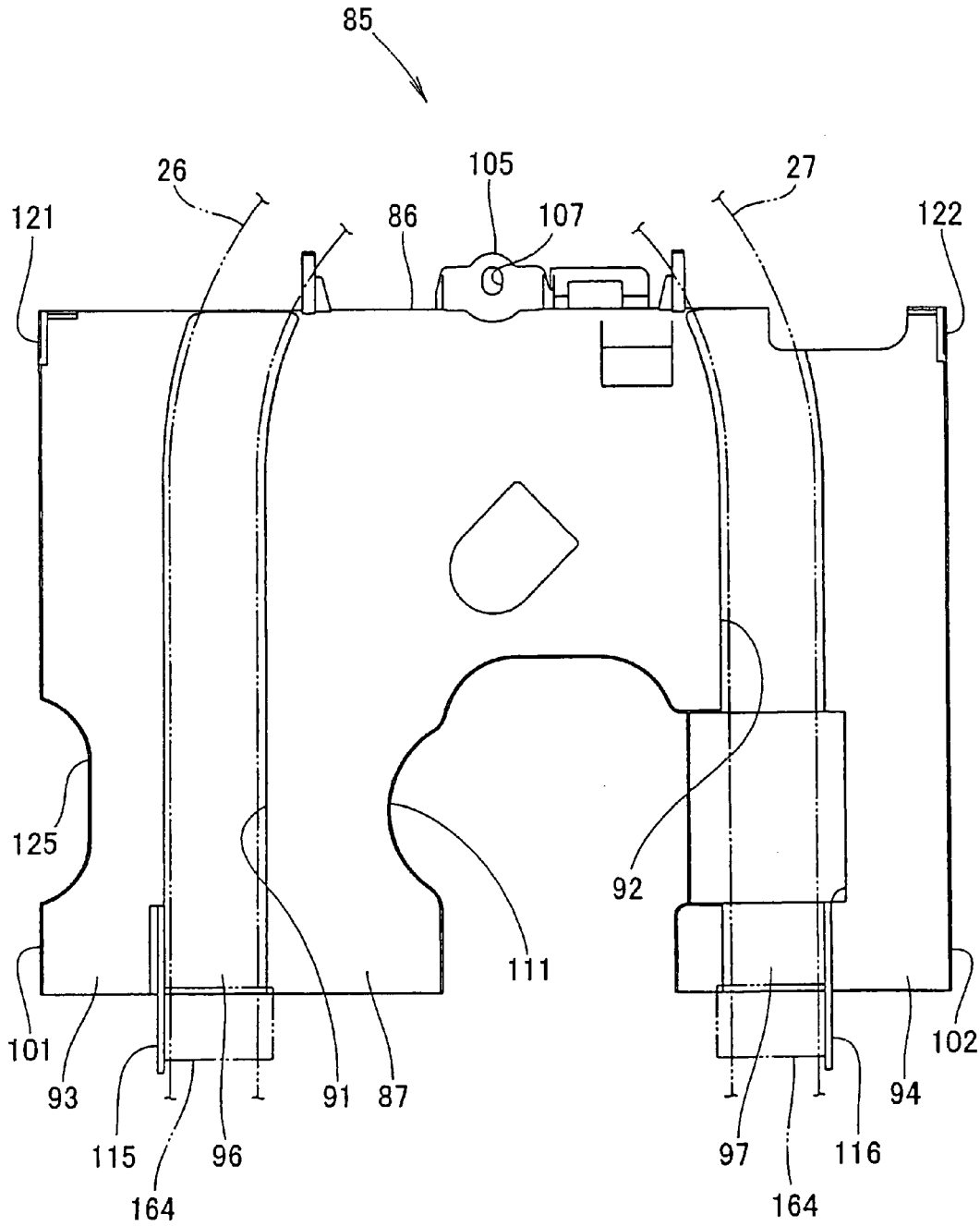
FIG. 4 is a back view of the air guide plate according to the present invention.

FIG. 4 is a back view of the air guide plate according to the present invention. The left-hand and right-hand longitudinal grooves 96 and 97 are formed at their upper portions so as to bend inwardly along the down tubes 26 and 27, respectively. The lower attachment portions 115 and 116 are disposed adjacently to the left-hand and right-hand longitudinal grooves 96 and 97, respectively, and are attached to the down tubes 26 and 27.

Figure 5:
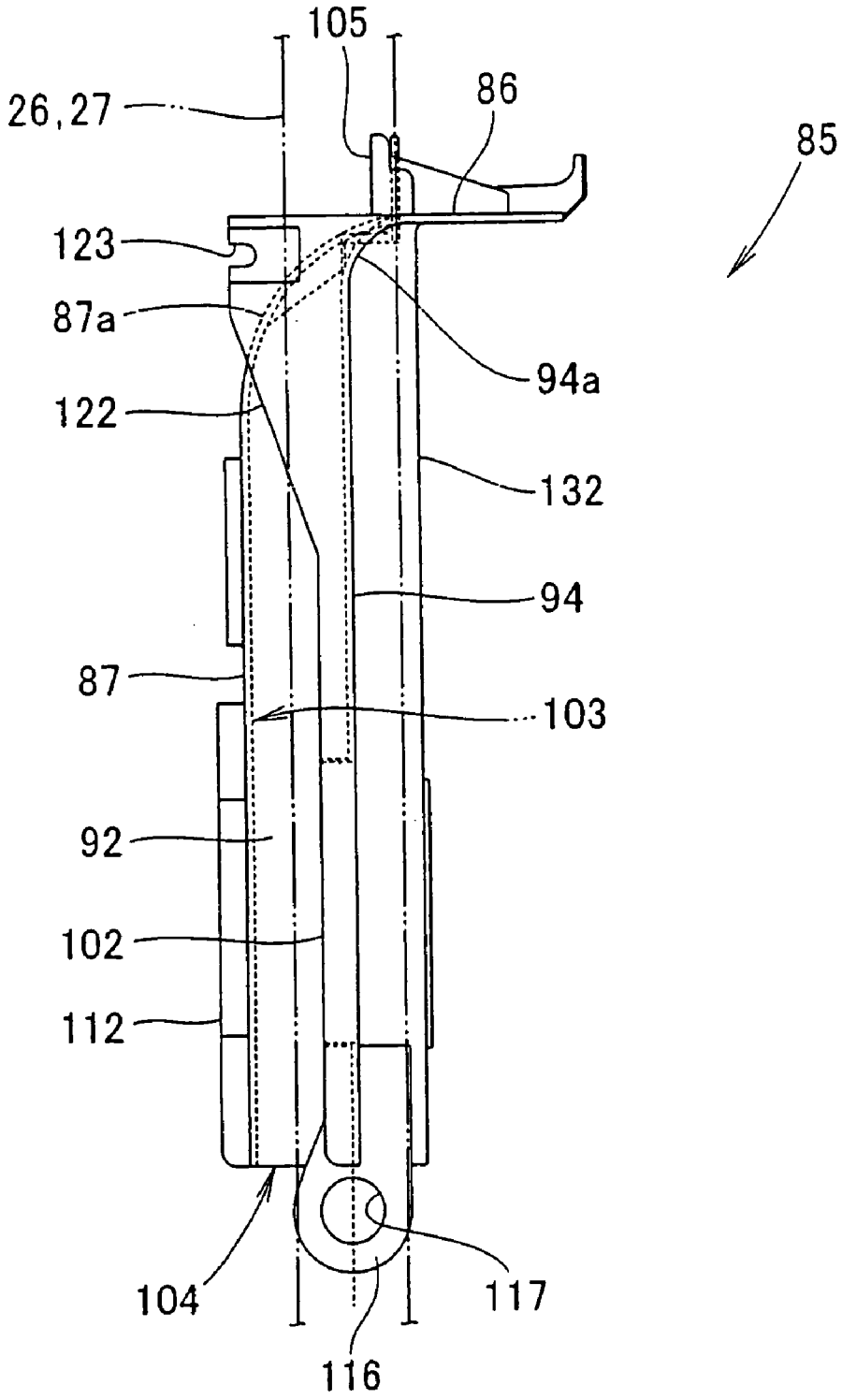
FIG. 5 is a lateral view of the air guide plate according to the present invention.

FIG. 5 is a lateral view of the air guide view according to the present invention. The rear wall 87 of the air guide plate 85 is formed with a circular-arc portion 87*a* at its upper portion. The laterally extending walls 93, 94 (only reference numeral 94 is shown) are respectively formed with circular-arc portions 93*a* and 94*a* (only reference numeral 94*a* is shown) at their upper portions. The circular-arc portions 85*a*, 93*a*, 94*a* function to cause the discharge air of the radiator 55 (see FIG. 2) led in the recess portion 103 by the upper wall 86 to smoothly and easily flow downwardly of the rear wall 87 and downwardly of the laterally extending walls 93, 94.

The lower attachment holes 117 of the lower attachment portions 115, 116 (only reference numeral 116 is shown) are arranged to centrally and substantially coincide with the down tubes 26, 27, respectively.

Figure 6:
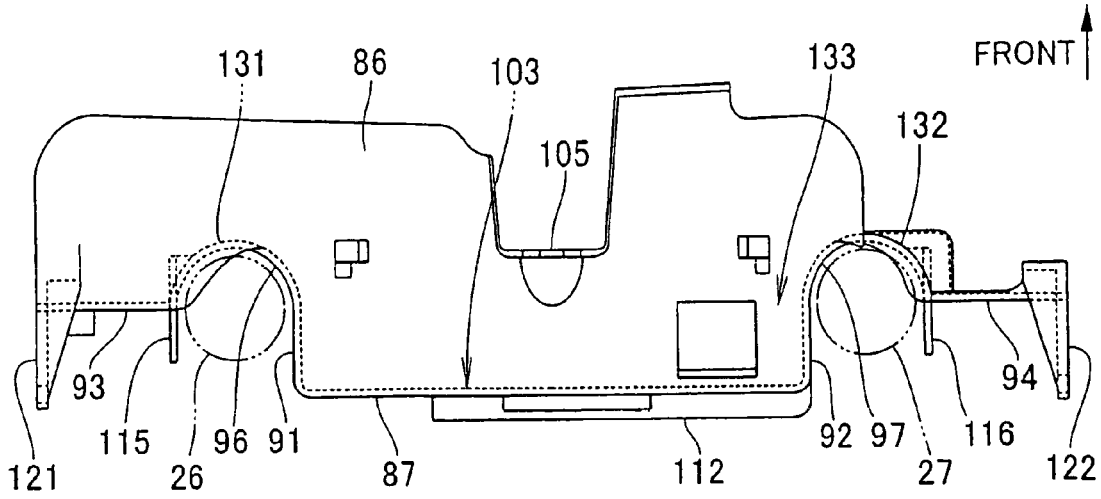
FIG. 6 is a plan view of the air guide plate according to the present invention.

FIG. 6 is a plan view of the air guide plate according to the present invention. In FIG. 6, the recess portion 103 of the air guide plate 85 is disposed inwardly of the left and right down tubes 26, 27.

The lateral walls 91 and 92 are contiguous to the circular-arc walls 131 and 132 forming the left-hand and right-hand longitudinal grooves 96 and 97, respectively. The circular-arc walls 131, 132 and lateral walls 91, 92 gather the discharge air of the radiator in the recess portion 103. In addition, a space 133 is defined between the left and right down tubes 26, 27.

Figure 7:
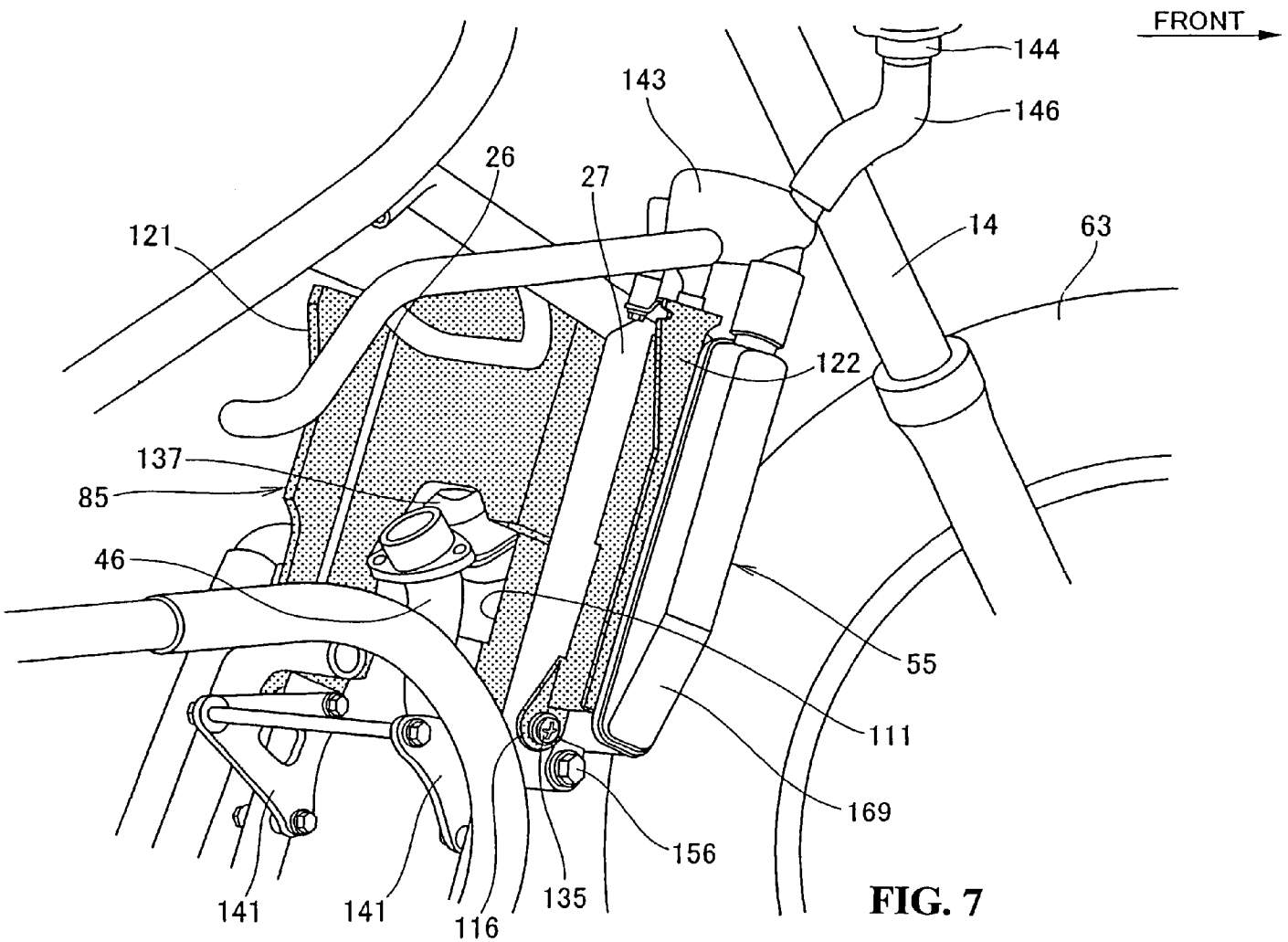
FIG. 7 is a first perspective view for assistance in explaining the air guide plate and radiator according to the present invention.

FIG. 7 is a first perspective view for explaining the air guide plate and radiator according to the present invention. In FIG. 7, the air guide plate 85 is attached to the down tubes 26 and 27 via the lower attachment portions 115 and 116 (only reference numeral 116 is shown), respectively, with screws 135, 135 and the exhaust pipe 46 passed through the notch 111.

In FIG. 7, a radiator fan is disposed between the radiator 55 and the air guide plate 85 to forcibly expel the discharge air of the radiator 55. Engine hangers 141, 141 are attached to the down tubes 26, 27 to support the front portion of the engine 12 (see FIG. 2). A thermostat case 143 connected to the radiator 55 and 144 denotes a radiator liquid inlet connected to the thermostat case 143 via a hose 146 and is attached with a radiator cap.

Figure 8:
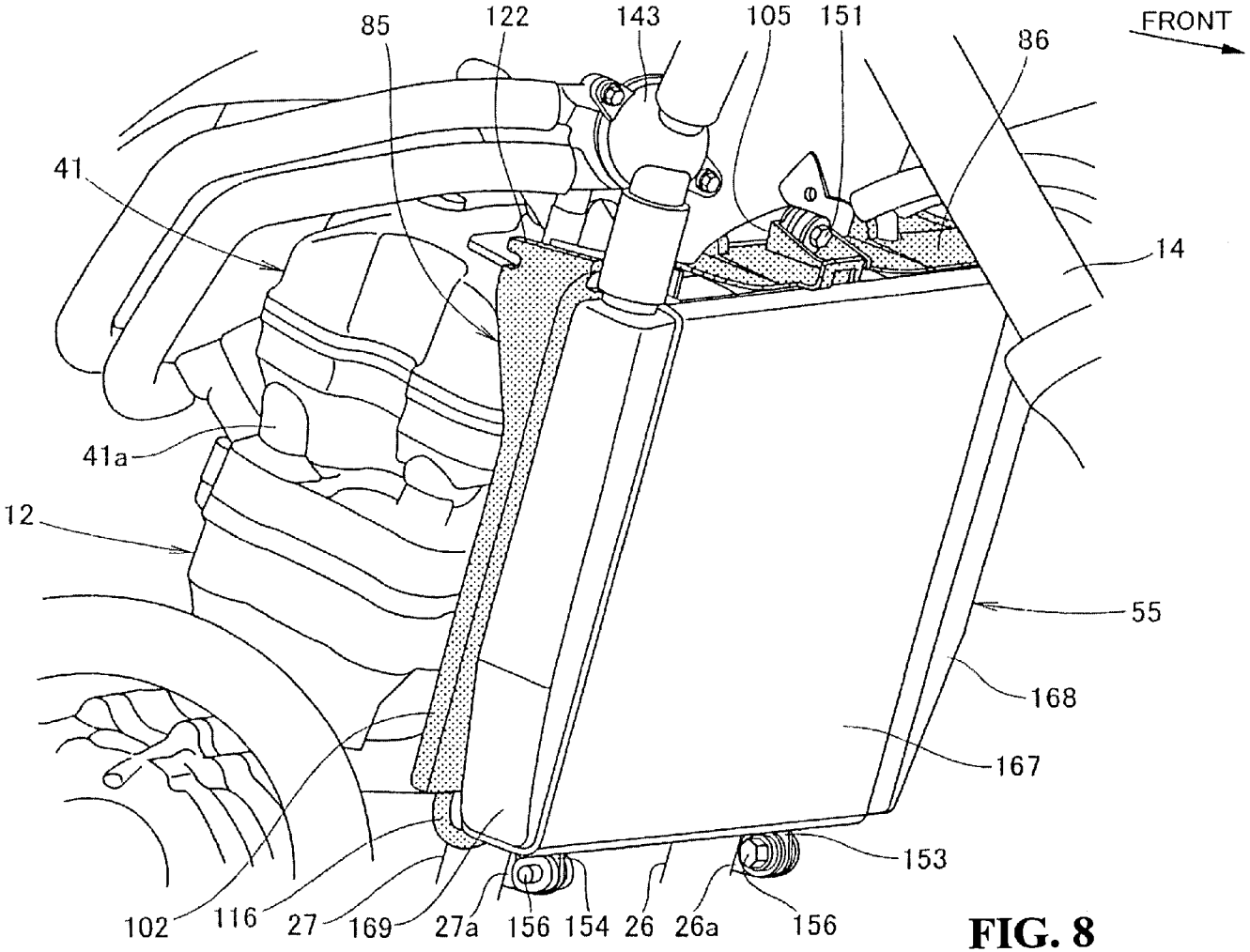
FIG. 8 is a second perspective view for assistance in explaining the air guide plate and radiator according to the present invention.

FIG. 8 is a second perspective view for explaining the air guide plate and the radiator according to the present invention. In FIG. 8, the upper attachment portion 105 provided at the upper portion of the air guide plate 11 is attached to the side of the body frame 11 (see FIG. 1) with a bolt 151. Radiator lower portion attachment portions 153, 154 provided at the lower portion of the radiator 55 are respectively attached to radiator support portions 26*a* and 27*a* provided at the down frames 26 and 27 with bolts 156, 156. The upper portion of the radiator 55 is attached to the side of the body frame 11.

Figure 9:
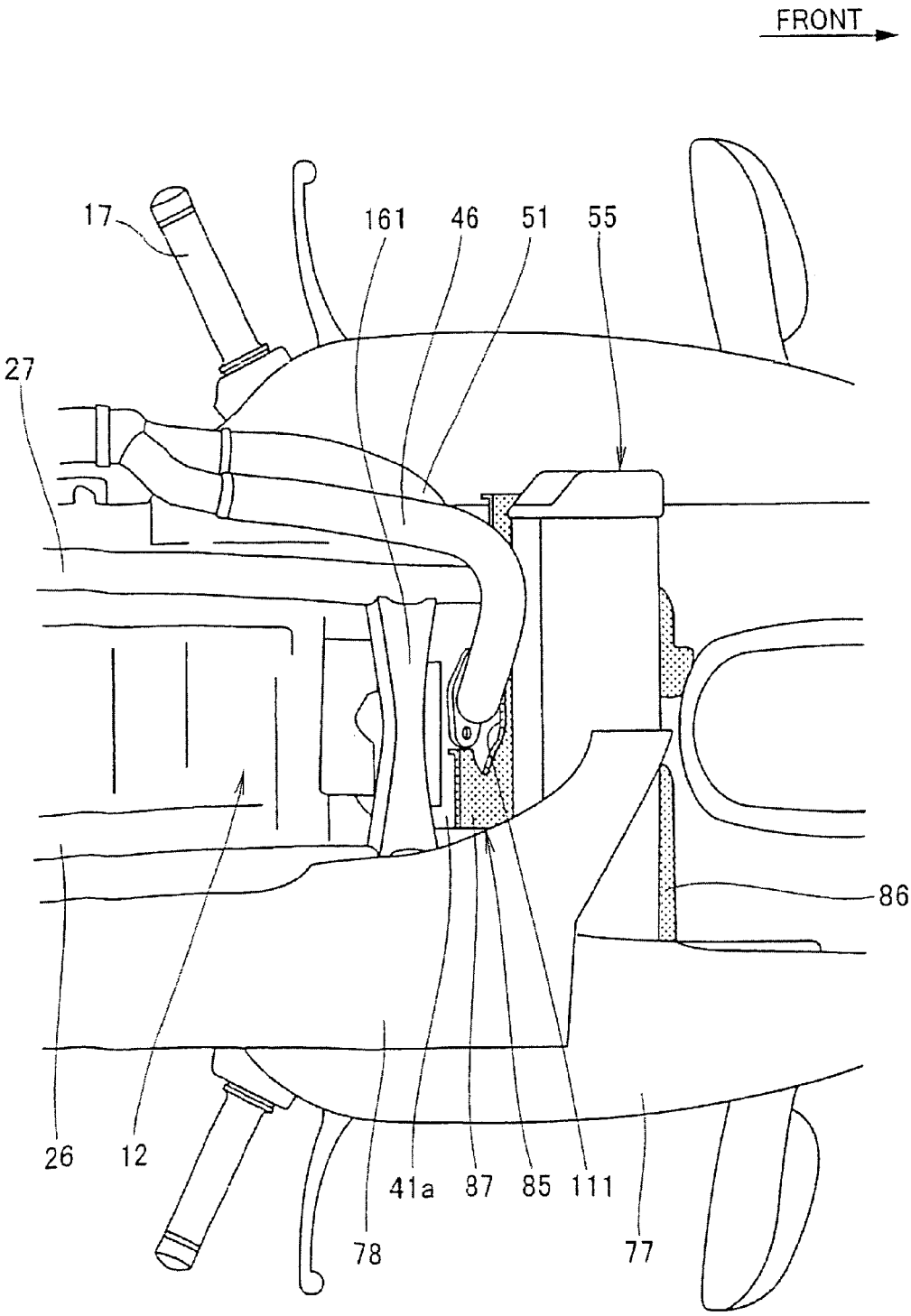
FIG. 9 is a bottom view for assistance in explaining the air guide plate and radiator according to the present invention.

FIG. 9 is a bottom view for assistance in explaining the air guide plate and the radiator according to the present invention. The exhaust pipe 46 attached to the cylinder head 41*a* of the engine 12 passes through the notch 111 formed in the air guide plate 85 and then extends below the radiator 55 toward the rearward of the vehicle body. In addition, FIG. 9 illustrates one of a pair of left and right middle cowls 77, 77 (only one reference numeral 77 is shown) and one of a pair of left and right lower cowls 78, 78 (only one reference numeral 78 is shown). A cross member 161 spans between the left and right down tubes 26, 27.

Figure 10:
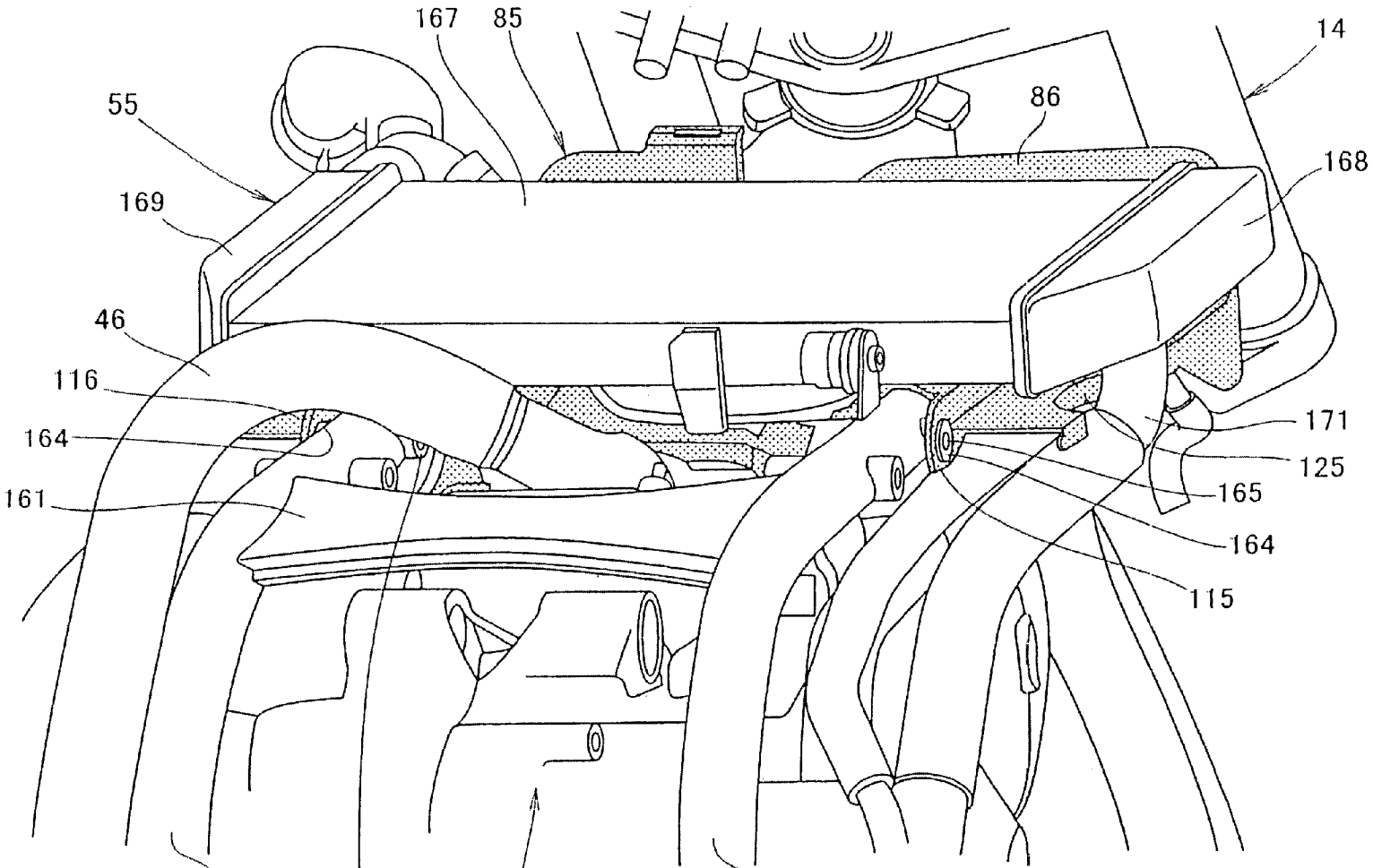
FIG. 10 is a third perspective view for assistance in explaining the air guide plate and radiator according to the present invention.

FIG. 10 is a third perspective view for assistance in explaining the air guide plate and the radiator according to the present invention, as viewed from the oblique downside of the radiator 55.

The down tubes 26, 27 are respectively attached with boss portions 164, 164 passing therethrough to attach the lower attachment portions 115, 116 of the air guide plate 85 to the lateral portions of the down tubes 26, 27. The lateral lower portions of the air guide plate 85 are respectively attached to the down tubes 26, 27 by screwing the screws 135 (see FIG. 7) into corresponding bolt holes 165 formed in the boss portions 164.

The radiator 55 includes a core 167 adapted to provide thermal exchange between radiator fluid and air and side tanks 168, 169 disposed on both sides of the core 167. A pipe 171 is attached to one side tank 168 and passes through the side lower notch 125 of the air guide plate 85.

The function of the air guide plate 85 described above is next explained.

Figure 11A:
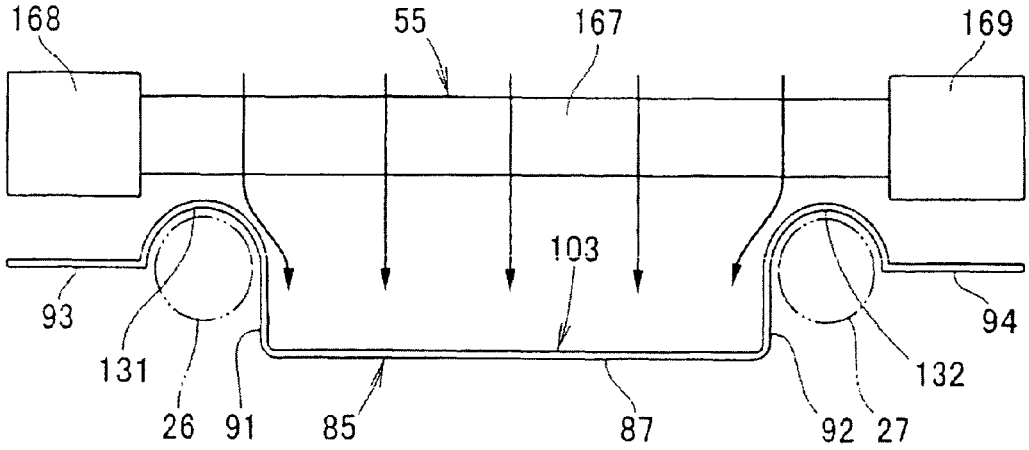
FIG. 11 includes functional views illustrating the function of the air guide plate according to the present invention.
Figure 11B:
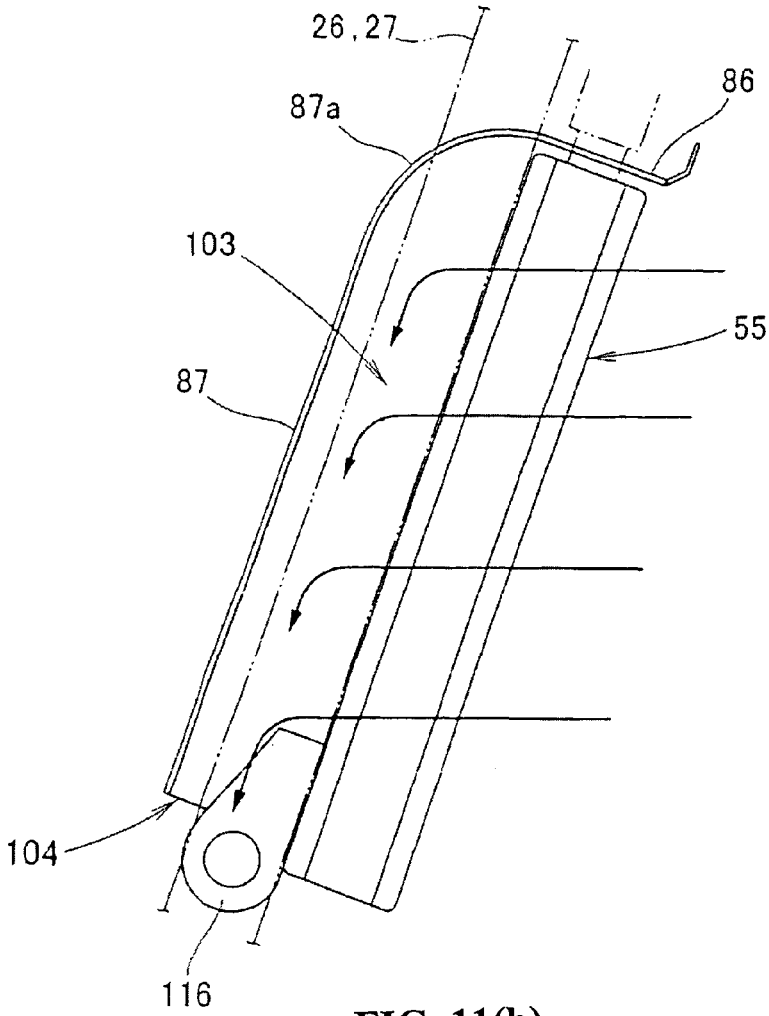

FIGS. 11(*a*) and 11(*b*) are functional views illustrating the function of the air guide plate according to the present invention. FIGS. 11(*a*) and 11(*b*) are a plan view and a lateral view, respectively.

In FIG. 11(*a*), when the radiator 55 receives air during operation, the flowing air passes through the radiator 55, as indicated with arrows, to become discharge air that is warmed up, which is gathered in the recess portion 103 by the circular-arc walls 131, 132 and lateral walls 91, 92 of the air guide plate 85.

In FIG. 11(*b*), the discharge air gathered in the recess portion 103 is turned obliquely downwardly along the rear wall 87 as indicated with arrows, discharged downwardly from the opening portion 104, passing below the engine, and flows rearwardly of the vehicle.

As shown in FIGS. 2 and 3, the present invention is firstly characterized in that in the vehicle 10 (see FIG. 1) including the engine 12 and the radiator 55 for cooling the engine 12 both attached to the body frame 11 and the air guide plate 85 adapted to lead the air striking the radiator 55 to a desired position, the air guide plate 85 is disposed between the radiator 55 and the engine 12 and is formed with the upper wall 86 at its upper portion, with the lateral walls 91, 92 (see FIG. 4 for the lateral wall 91) at the respective left and right lateral portion of the air guide plate 85, and with the opening portion 104 at its lower portion.

Thus, the discharge air passing the radiator 55 can be discharged downwardly along the air guide plate 85 to prevent the engine 12 from getting the discharge air of the radiator 55, thereby preventing thermal influence on the engine 12.

The present invention as illustrated in FIGS. 1, 5 and 6 includes the body frame 11 with the pair of left and right down tubes 26, 27 extending almost downwardly from the head pipe 13 provided at the front end of the body frame 11, the radiator 55 is disposed forward of the down tubes 26, 27 with respect to the vehicle body, and the pair of left and right lateral walls 91, 92 of the air guide plate 85 is disposed between the left and right down tubes 26, 27 so as to overlap the down tubes 26, 27 as viewed from the lateral side.

In this way, since the recess portion 103 is provided in the space 133 between the down tubes 26, 27, the space 133 can effectively be utilized as a space adapted to arrange the air guide space 85 therein and as a discharge air passage, thereby leading the discharge air downward of the engine 12.

The present invention as shown in FIGS. 7 and 9 includes the air guide plate 85 that is provided with the notch 111 adapted to receive the exhaust pipe 46, passed therethrough, extending from the engine 12.

Thus, the discharge air of the radiator 55 can lead the hot air of the exhaust pipe 46 toward the downside of the engine, thereby making it difficult for the engine 12 to get the hot air of the exhaust pipe 46.

The present invention as shown in FIGS. 4 and 10 includes the air guide plate 85 that is provided with the lower attachment portions 115 and 116 serving as extensions which are respectively disposed on the leftward and rightward externally lateral sides of the left and right down tubes 26 and 27 and the left and right lower attachment portions 115 and 116 that are supported respectively by the boss portions 164 and 164 serving as support portions provided on the external lateral surfaces of the left and right down tubes 26 and 27.

Thus, the air guide plate 85 can easily be attached to the down tubes 26, 27 from the lateral side of the vehicle body, thereby enhancing assembly performance.

In the present embodiment, the recess portion 103 is formed at the center of the air guide plate 85 as shown in FIG. 3. However, the present invention is not limited to this embodiment. Respective walls may be formed at the left and right edge portions of the laterally extending walls 93 and 94 provided on both sides of the recess portion 103. Consequently a recess portion is formed to cause the laterally extending walls 93, 94 to serve as respective bottoms on the left and right sides of the recess portion 103. Thus, such a recess portion causing the laterally extending walls 93, 94 to serve as the respective bottoms can gather the discharge air of the radiator and discharge it downward of the engine.

The vehicle air guide plate of the present invention is suitable for motorcycles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air guide plate for a vehicle comprising:

an engine and a radiator for cooling the engine both attached to a body frame, wherein the air guide plate adapted to lead air striking the radiator to a desired position;

wherein the air guide plate is disposed between the radiator and the engine and is formed with an upper wall at an upper portion thereof, with lateral walls at respective left and right lateral portions thereof, and with an opening portion at a lower portion thereof, wherein the air guide plate is provided with a plate-shaped rear wall which is parallel to and spaced apart from a rear side of the radiator, and wherein the opening portion is formed at a lower portion of the rear wall, and wherein the left and right lateral walls have lengths extending rearwardly and obliquely downward in a direction that is parallel to right and left sides of the radiator, wherein the body frame comprises a pair of left and right down tubes extending rearwardly and obliquely downward from a head pipe provided at a front end of the body frame;

the radiator is disposed forward of the down tubes with respect to the vehicle body; and the left and right lateral walls having lengths extending rearwardly and obliquely downward are disposed between and extend parallel to the left and right down tubes so as to overlap the down tubes as viewed from a lateral side of the down tubes.

2. The air guide plate for the vehicle according to claim 1, wherein the air guide plate is provided with a notch adapted to receive an exhaust pipe passing therethrough, the exhaust pipe extending from the engine.

3. The air guide plate for the vehicle according to claim 1, wherein the air guide plate is provided with extensions which are respectively disposed leftward and rightward externally with respect to the lateral sides of the left and right down tubes, and the left and right extensions are respectively supported by the support portions provided on external lateral surfaces of the left and right down tubes.

4. An air guide plate comprising:

an upper wall at an upper portion thereof;

lateral walls at respective left and right lateral portions thereof;

a plate-shaped rear wall extending between and directly connecting the left and right lateral portions; and an opening portion at a lower portion thereof;

wherein said air guide plate is adapted to be disposed between a radiator and an engine with said upper wall and said rear wall of the air guide plate adapted to lead air striking the radiator rearwardly and obliquely downward in a space between a rear side of the radiator and the rear wall to a desired position.

5. The air guide plate for the vehicle according to claim 1, wherein the rear wall of the air guide plate curves rearwardly and obliquely downward from the upper wall of the air guide plate.

6. The air guide plate for the vehicle according to claim 1, wherein the air guide plate is provided with a notch adapted to receive an exhaust pipe passing therethrough, the exhaust pipe extending from the engine, wherein the rear wall of the air guide plate curves rearwardly and obliquely downward from the upper wall of the air guide plate, and wherein the rear wall of the air guide plate is a plate-shaped member which is spaced apart from a rear side of the radiator.

7. An air guide plate adapted for use with a vehicle the air guide plate being adapted to lead air striking a radiator to a desired position;

wherein the air guide plate is adapted to be disposed between the radiator and an engine, said air guide plate including:

an upper wall at an upper portion thereof;

lateral walls at respective left and right lateral portions thereof; and an opening portion at a lower portion thereof, and wherein the left and right lateral walls have lengths extending rearwardly and obliquely downward in a direction that is parallel to right and left sides of the radiator, wherein the air guide plate is provided with a plate-shaped rear wall which is parallel to and spaced apart from a rear side of the radiator, and wherein the opening portion is formed at a lower portion of the rear wall.

8. The air guide plate adapted for use with a vehicle according to claim 7, wherein a body frame comprises a pair of left and right down tubes extending rearwardly and obliquely downward from a head pipe provided at a front end of the body frame;

the radiator is disposed forward of the down tubes with respect to a vehicle body; and the left and right lateral walls are disposed between the left and right down tubes so as to overlap the down tubes as viewed from a lateral side of the down tubes.

9. The air guide plate adapted for use with a vehicle according to claim 7, wherein the air guide plate is provided with a notch adapted to receive an exhaust pipe passing therethrough, the exhaust pipe extending from the engine.

10. The air guide plate adapted for use with a vehicle according to claim 8, wherein the air guide plate is provided with a notch adapted to receive an exhaust pipe passing therethrough, the exhaust pipe extending from the engine.

11. The air guide plate adapted for use with a vehicle according to claim 7, wherein the air guide plate is provided with extensions which are respectively disposed leftward and rightward externally with respect to lateral sides of the left and right down tubes, and the left and right extensions are respectively supported by the support portions provided on external lateral surfaces of the left and right down tubes.

12. The air guide plate adapted for use with a vehicle according to claim 8, wherein the air guide plate is provided with extensions which are respectively disposed leftward and rightward externally with respect to the lateral sides of the left and right down tubes, and the left and right extensions are respectively supported by the support portions provided on external lateral surfaces of the left and right down tubes.

13. The air guide plate adapted for use with a vehicle according to claim 9, wherein the air guide plate is provided with a rear wall which curves rearwardly and obliquely downward from the upper wall of the air guide plate.

14. The air guide plate for the vehicle according to claim 4, wherein the air guide plate is provided with extensions which are respectively disposed leftward and rightward externally with respect to lateral sides of the left and right down tubes, and the left and right extensions are respectively supported by the support portions provided on external lateral surfaces of the left and right down tubes.

15. The air guide plate according to claim 4, wherein a body frame comprises a pair of left and right down tubes extending rearwardly and obliquely downward from a head pipe provided at a front end of the body frame;

the radiator is disposed forward of the down tubes with respect to a vehicle body; and the left and right lateral walls are disposed between the left and right down tubes so as to overlap the down tubes as viewed from the lateral side.

16. The air guide plate according to claim 4, wherein the air guide plate is provided with a notch adapted to receive an exhaust pipe passing therethrough, the exhaust pipe extending from the engine.

17. The air guide plate according to claim 15, wherein the air guide plate is provided with a notch adapted to receive an exhaust pipe passing therethrough, the exhaust pipe extending from the engine.

* * * * *